US009312652B2

(12) United States Patent
Smith et al.

(10) Patent No.: US 9,312,652 B2
(45) Date of Patent: Apr. 12, 2016

(54) SWITCHABLE MODULAR JACK ASSEMBLY FOR TELECOMMUNICATIONS SYSTEMS

(71) Applicant: Tii Technologies Inc., Edgewood, NY (US)

(72) Inventors: Thomas J. Smith, Bay Shore, NY (US); Raymond Pepe, Rocky Point, NY (US)

(73) Assignee: Tii Technologies Inc., Edgewood, NY (US)

( * ) Notice: Subject to any disclaimer, the term of this patent is extended or adjusted under 35 U.S.C. 154(b) by 37 days.

(21) Appl. No.: 14/208,567

(22) Filed: Mar. 13, 2014

(65) Prior Publication Data

US 2014/0273649 A1 Sep. 18, 2014

Related U.S. Application Data

(60) Provisional application No. 61/781,634, filed on Mar. 14, 2013.

(51) Int. Cl.

| | |
|---|---|
| ***H01R 24/00*** | (2011.01) |
| ***H01R 31/08*** | (2006.01) |
| ***H01R 24/64*** | (2011.01) |
| ***H01R 13/703*** | (2006.01) |
| ***H01R 31/06*** | (2006.01) |

(52) U.S. Cl.

CPC ..... *H01R 31/08* (2013.01); *H01R 13/703* (2013.01); *H01R 24/64* (2013.01); *H01R 31/06* (2013.01)

(58) Field of Classification Search

CPC ... H01R 23/025; H01R 2103/00; H01R 31/06

USPC ..... 439/676, 188, 638, 639

See application file for complete search history.

(56) References Cited

U.S. PATENT DOCUMENTS

| | | | | | |
|---|---|---|---|---|---|
| 4,552,423 | A * | 11/1985 | Swengel, Jr. | H01R 13/7032 | 200/51.1 |
| 4,725,241 | A * | 2/1988 | Bertini | H01R 13/7035 | 200/51.1 |
| 5,030,123 | A * | 7/1991 | Silver | H01R 13/7031 | 200/51.1 |
| 5,704,797 | A * | 1/1998 | Meyerhoefer | H01R 4/2433 | 200/51.12 |
| 5,791,943 | A * | 8/1998 | Lo | H01R 13/6397 | 439/491 |
| 5,885,111 | A * | 3/1999 | Yu | H01R 24/64 | 439/676 |
| 5,957,720 | A * | 9/1999 | Boudin | H01R 24/64 | 439/409 |
| 6,267,617 | B1 * | 7/2001 | Nozick | H01R 4/2433 | 439/404 |
| 6,612,856 | B1 * | 9/2003 | McCormack | H01R 13/6485 | 200/51.1 |
| 6,676,423 | B1 * | 1/2004 | Marowsky | H01R 13/6485 | 439/181 |
| 6,900,629 | B2 * | 5/2005 | Hwang | G01R 31/041 | 324/66 |
| 7,572,148 | B1 * | 8/2009 | Pepe | H01R 13/514 | 439/607.05 |

* cited by examiner

*Primary Examiner* — Hae Moon Hyeon

(74) *Attorney, Agent, or Firm* — Gerald T. Bodner

(57) ABSTRACT

A switchable modular jack assembly includes a housing which defines a receptacle for receiving an RJ14 modular plug, and a socket for receiving a pre-wired adapter plug. Each of the RJ14 modular plug and the adapter plug has electrical contacts on an exposed surface thereof. The jack assembly also includes leaf spring electrical contacts which extend into the receptacle and socket. When no RJ14 modular plug is received by the receptacle, the leaf spring electrical contacts contact the electrical contacts of the adapter plug. When an RJ14 modular plug is received by the receptacle, the leaf spring electrical contacts contact the electrical contacts of the RJ14 modular plug, but not the electrical contacts of the adapter plug.

9 Claims, 6 Drawing Sheets

SWITCHABLE MODULAR JACK ASSEMBLY FOR TELECOMMUNICATIONS SYSTEMS

CROSS-REFERENCE TO RELATED APPLICATIONS

This application is related to the U.S. Provisional Application Ser. No. 61/781,634, filed on Mar. 14, 2013, and entitled "Switchable Modular Jack Assembly For Telecommunications Systems", the disclosure of which is incorporated herein by reference and on which priority is hereby claimed.

BACKGROUND OF THE INVENTION

1. Field of the Invention

The present invention generally relates to equipment used in a telecommunications system, and more particularly relates to devices and components used in telephone systems. Even more specifically, the invention relates to switching modular jacks used in telephone systems for testing the telephone lines, among other uses.

2. Description of the Prior Art

U.S. Pat. No. 5,704,797 (Meyerhoefer, et al.) discloses a switchable electrical socket used for testing telephone lines. The electrical socket described in the Meyerhoefer, et al. patent is, essentially, an RJ11 modular jack having switching capabilities. Generally, the modular jack acts as a switch to disconnect electrically the tip (green) and ring (red) lines coming into a network interface device (NID) from a telephone company ("telco") from the subscriber telephone wiring downstream of the NID in order to test the lines to determine where a fault may lie.

Since telephone subscribers are permitted to install their own telephone equipment and other communications equipment, such as modems, routers, switches, residential gateways and the like, these subscribers are responsible for the care and maintenance of such equipment and the wiring in the subscriber premises. The telephone company is responsible for service only up to the juncture between the telco wiring and the subscriber wiring, that is, generally at the NID. Therefore, it is important to provide a device which allows a subscriber to disconnect and reconnect the subscriber wiring from the telco wiring to isolate where a wiring fault occurs, i.e., either in the telco wiring upstream of the NID or the wiring in the customer (subscriber) premises.

The switchable RJ11 modular jack disclosed in the aforementioned Meyerhoefer, et al. patent fulfills this requirement. Such a switchable modular jack may be incorporated directly in a customer bridge module in the NID, or may be situated outside the NID in a separate housing and electrically connected to the components in the NID.

With high speed data now being provided to customer premises by the telephone company over cables having multiple twisted pairs of wires, not only is the twisted pair of tip (green) and ring (red) lines of POTS (Plain Old Telephone Service) wiring used, but also the commonly recognized black and yellow twisted pair of lines is used. To accommodate and interconnect with such double twisted pairs of wires, RJ14 modular jacks and plugs are commonly used rather than RJ11 jacks and plugs. Since the black and yellow wires also carry telecommunications signals, just like the tip (green) and ring (red) wires, there is a need to test these lines, as well.

OBJECTS AND SUMMARY OF THE INVENTION

It is an object of the present invention to provide a switchable modular jack assembly for testing multiple lines of a telecommunications system.

It is another object of the present invention to provide a switchable modular jack assembly which may accept and interface with a standard RJ14 plug.

It is still another object of the present invention to provide a switchable modular jack assembly for use in a telecommunications system which is simple in structure, cost effective to manufacture and easily operable for a non-technical person, such as a telephone subscriber, to disconnect and reconnect telecommunications wiring in the subscriber premises for testing and other purposes.

In one form of the present invention, a switchable modular jack assembly electrically connectable to multiple pairs of twisted or non-twisted wires includes a first, inner housing, a second, outer protective housing covering the inner housing, and a plurality of electrical contacts, some of which are resilient, leaf spring contacts.

One side of the inner housing has formed therein a receptacle, or "jack", for removably receiving a standard RJ14 modular plug. The opposite side of the inner housing has formed therein a socket for captively receiving an RJ14 adapter plug. The adapter plug socket is joined to and communicates with the plug receptacle. The adapter plug has exposed on one of its sides four electrical contacts, for connection to the tip (green) and ring (red) lines, and yellow and black lines, of a telecommunications system cable.

As mentioned previously, the switchable modular jack assembly of the present invention also includes preferably four resilient, leaf spring electrical contacts, the contacts being for electrical connection with the tip (green), ring (red), yellow and black wires. The proximate lead portions of such contacts are embedded in and held firmly by the inner housing, and the distal resilient free ends of each contact project into the receptacle, or jack, which receives the standard RJ14 plug, as well as into the socket where the RJ14 adapter plug is captively received.

With no RJ14 plug inserted in the receptacle of the switchable modular jack assembly, the resilient free ends of the leaf spring contacts extend further into the receptacle and socket to touch the exposed contacts on the RJ14 adapter plug. This causes an electrical circuit to be made between wires connected to the resilient leaf spring contacts and wires connected to the contacts of the RJ14 adapter plug.

However, when a standard RJ14 plug is inserted into the plug receptacle on the switchable modular jack assembly, the body of the plug pushes the leaf spring contacts away from the RJ14 adapter plug contacts, breaking the electrical circuit between them. When the plug is fully inserted into the receptacle, the contacts of the RJ14 modular plug touch the leaf spring contacts and complete an electrical circuit between the wires connected to the leaf spring contacts and the wires connected to the RJ14 plug.

The leaf spring contacts may be connected to the central office, or telco, side wiring, and the wires of the RJ14 adapter plug may be connected to the customer side wiring. Accordingly, without a standard RJ14 plug inserted into the receptacle of the assembly, the customer side wiring is electrically connected to the telco wiring. When the RJ14 plug is inserted into the corresponding receptacle on the assembly, the connection between the telco wiring and the customer side wiring is broken, and an electrical connection is made between the telco wiring and the RJ14 plug. Accordingly, a customer may test to see if a fault exists in the wiring from the telephone company by inserting the RJ14 plug connected to a telephone or other piece of communications equipment into the plug receptacle of the assembly.

An alternative operation of the switchable modular jack assembly of the present invention, especially when it is used on a customer bridge module in an NID, would be a situation where an RJ14 plug is connected to the assembly during normal use. Here, the RJ14 plug contacts are electrically connected to the customer side wiring so as to provide an electrical circuit between the telco wiring, connected to the leaf spring contacts of the switchable modular jack assembly, and the customer side wiring, with the leaf spring contacts engaging the contacts of the RJ14 plug to provide such an electrical connection. The contacts of the RJ14 adapter plug may be electrically connected to a pair of SELT (Single Ended Loop Test) circuits, one circuit testing the tip line—ring line loop, and the other circuit testing the yellow line—black line loop. With the switchable modular jack assembly wired in such a configuration, the customer would remove the RJ14 plug from the plug receptacle of the assembly so that an electrical circuit is made between the resilient leaf spring contacts connected to the telco wiring and the contacts of the RJ14 adapter plug connected to the SELT circuits.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

FIGS. 1-6 illustrate one form of a switchable modular jack assembly 2 formed in accordance with the present invention. The switchable modular jack assembly 2 basically includes a first, inner housing 4, a second, outer protective housing 6 covering the inner housing 4, and a plurality of electrical contacts, some of which are resilient, leaf spring contacts 8.

Figure 1:
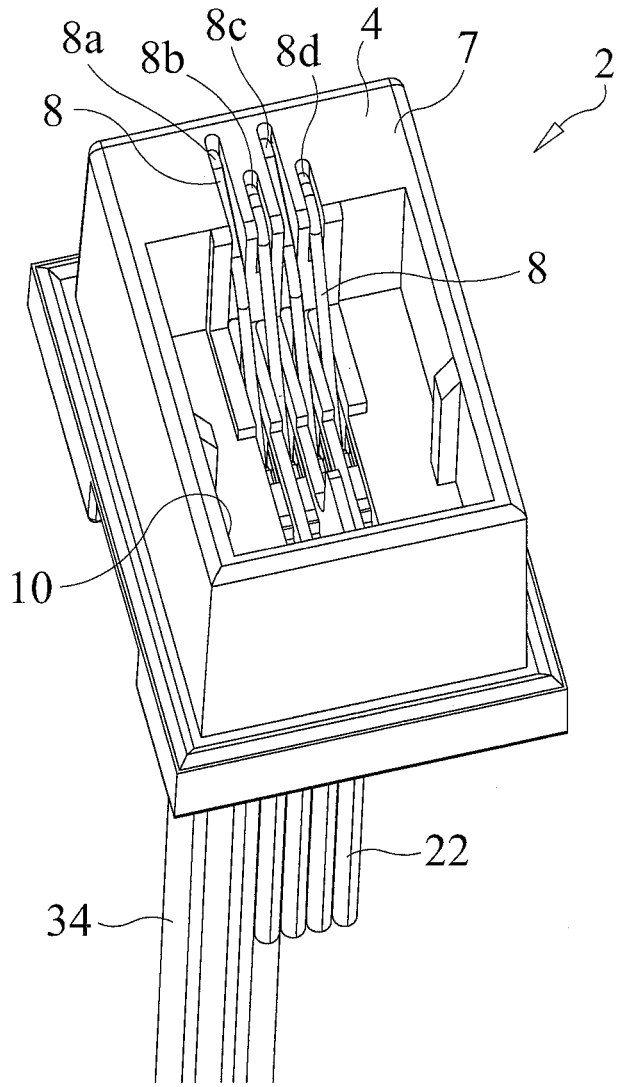
FIG. 1 is a top perspective view of the inner housing of a switchable modular jack assembly constructed in accordance with the present invention.

The inner housing 4 of the assembly 2 is shown in FIG. 1 of the drawings. It is generally rectangular in shape, and includes on one side 7 thereof a receptacle 10, or "jack", for removably receiving a standard RJ14 modular plug 12. The RJ14 plug 12, as is well known, is connected to a cable carrying four wires 14, conventionally having jackets colored in red, green, black and yellow to differentiate one from the other. The four wires 14 are connected to exposed contacts on the RJ14 plug 12, and the four contacts mate with resilient leaf spring contacts 8 extending into the plug receptacle 10 of the assembly, as is shown in FIG. 1 and as will be described in greater detail.

Figure 2:
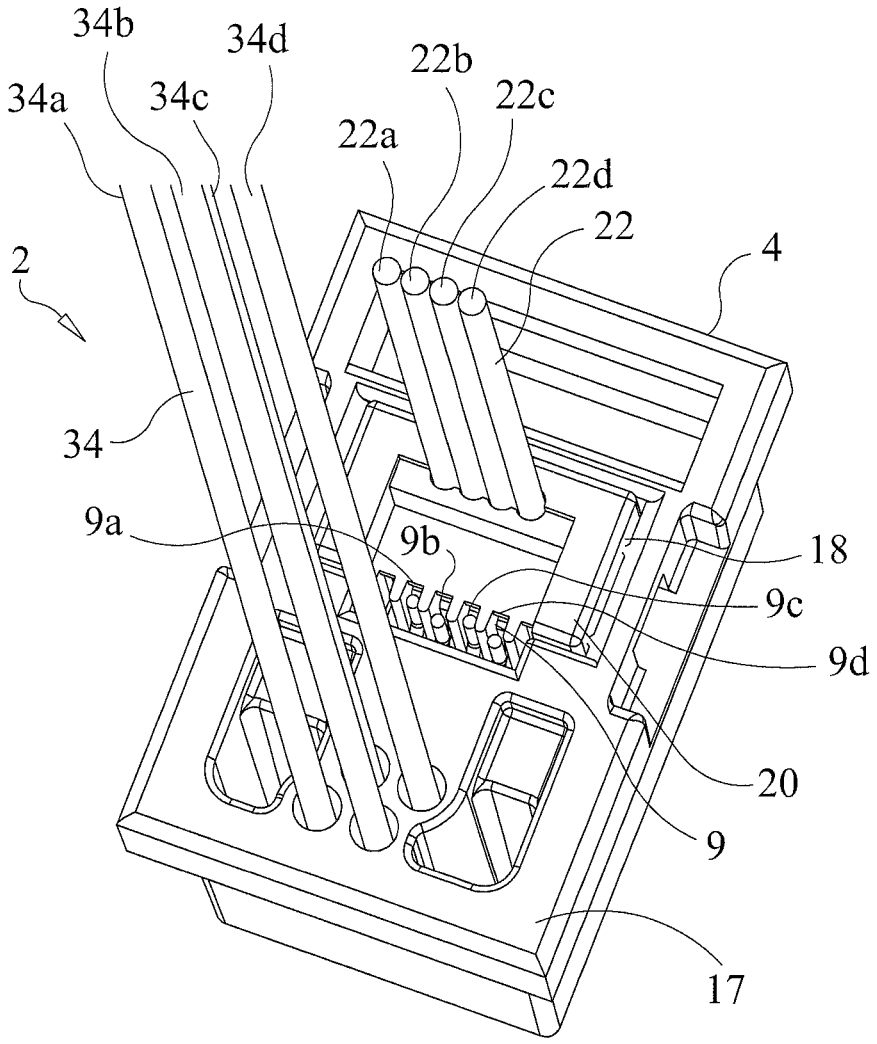
FIG. 2 is a bottom perspective view of the inner housing and RJ14 adapter plug of the switchable modular jack assembly of the present invention.
Figure 3:
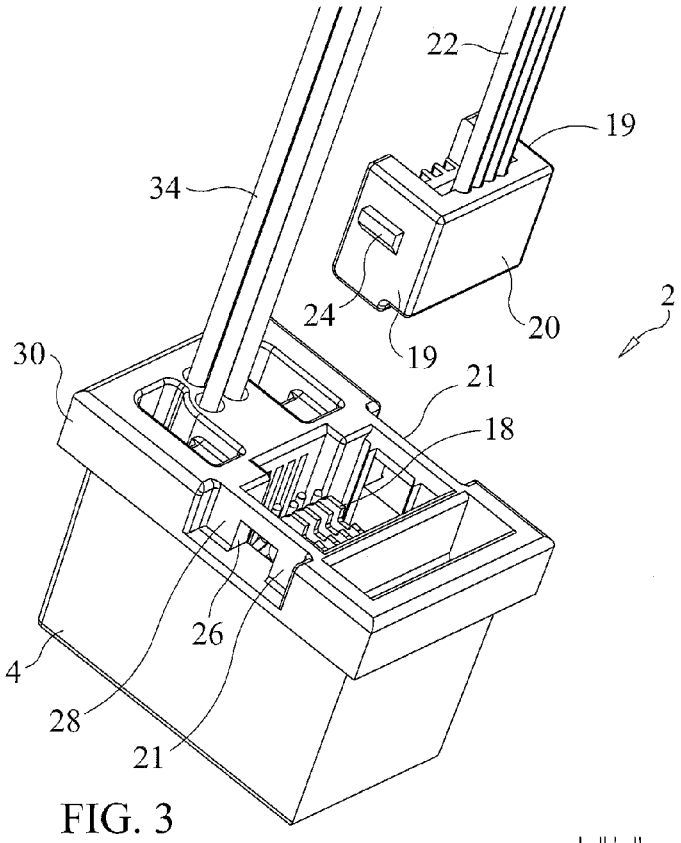
FIG. 3 is a partially exploded, perspective view of the inner housing and RJ14 adapter plug of the switchable modular jack assembly of the present invention.
Figure 4:
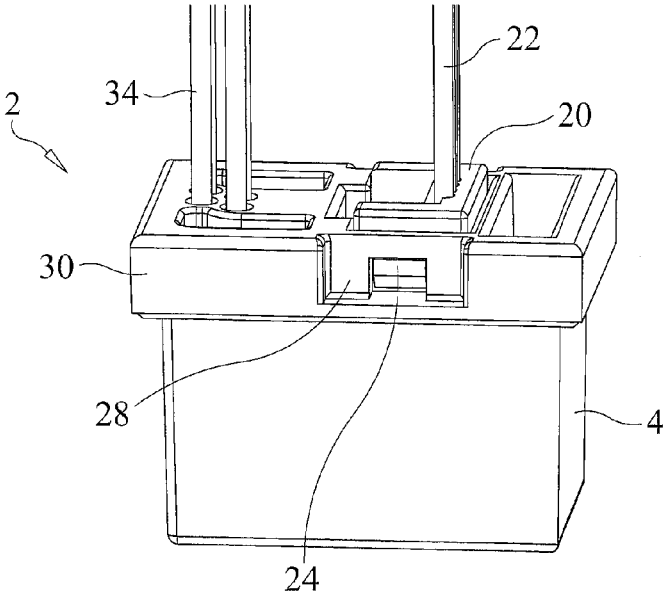
FIG. 4 is another perspective view of the inner housing and the RJ14 adapter plug of the switchable modular jack assembly of the present invention.

On the opposite side 17 of the inner housing 4, there is formed a socket 18 for captively receiving an RJ14 adapter plug 20, as shown in FIGS. 2-4 of the drawings. The adapter plug socket 18 is joined to and communicates with the plug receptacle 10 internally through the inner housing 4. The adapter plug 20 has exposed on one of its sides four electrical contacts, for connection to the tip (green) and ring (red) lines, and yellow and black lines 22, of a telecommunications system cable, or to other equipment or components, such as SELT circuits for testing the lines. As can be seen in FIGS. 3 and 4 of the drawings, opposite lateral sides of the RJ14 adapter plug 20 include outwardly protruding barbs 24 which are received in windows 26 formed in resilient recessed portions 28 of an outwardly extending flange 30 surrounding the main body of the inner housing 4. The engagement of the barbs 24 on the RJ14 adapter plug and the windows 26 in the resilient recessed portions 28 of the inner housing 4 of the assembly 2 acts to captively retain the RJ14 adapter plug 20 within the corresponding socket 18 of the assembly 2.

As mentioned above, the switchable modular jack assembly 2 of the present invention includes four resilient, leaf spring electrical contacts 8. The proximate lead portions 32 of such contacts 8 are embedded in and held firmly by the inner housing 4 of the assembly 2. The lead portions 32 of the leaf spring contacts 8 may be in the form of insulation displacement contacts (IDCs) to facilitate their connection to wiring outside the assembly, or may be in the form of wire wrap leads or printed circuit board leads, for example. The embedded lead portions 32 of the contacts 8 are connected to electrical wires 34 of the telephone system, such as the tip (green), ring (red), yellow and black lines of the telco side wiring.

The resilient distal free ends 36 of the contacts 8 project into the receptacle 10, or jack, which receives the standard RJ14 plug 12, as well as into the socket 18 in which the RJ14 adapter plug 20 is received so as to selectively electrically engage the exposed contacts on the RJ14 adapter plug 20 when no RJ14 modular plug 12 is inserted into the plug receptacle 10 of the assembly 2. The resilient free ends 36 of the leaf spring contacts 8 are preferably gold plated, as are preferably the contacts of the RJ14 adapter plug 20.

Figure 5:
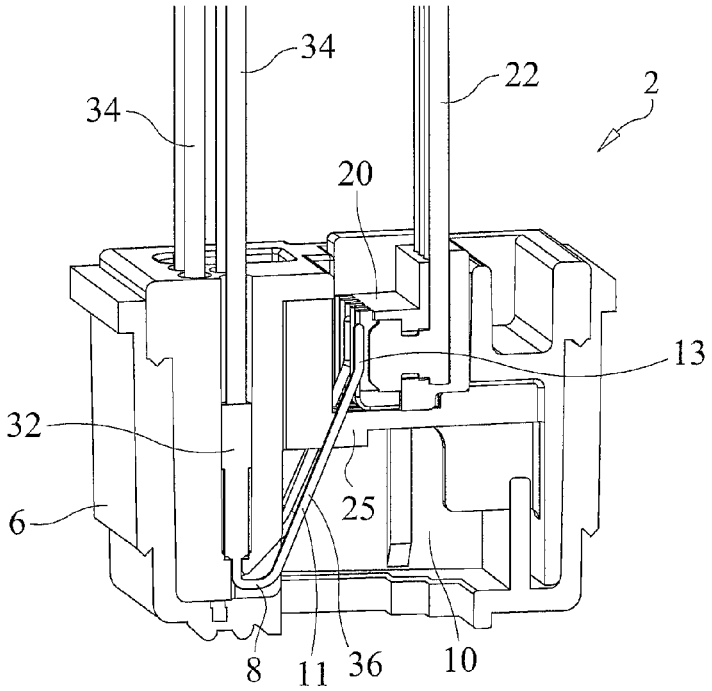
FIG. 5 is a partially cut away, perspective view of the switchable modular jack assembly of the present invention, showing the outer protective housing, the inner housing and the RJ14 adapter plug of the assembly, and further illustrating the position of the resilient leaf spring contacts of the assembly when no RJ14 plug is received by the assembly.
Figure 6:
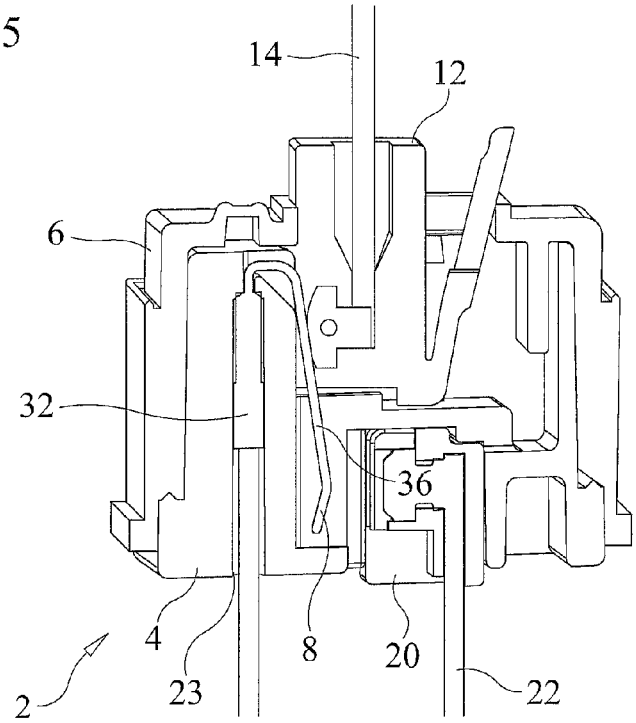
FIG. 6 is a partially cut away, perspective view of the switchable modular jack assembly of the present invention, and illustrating the position of the resilient leaf spring contacts of the assembly when a standard RJ14 plug is inserted into the assembly.

As can be seen from FIGS. 5 and 6 of the drawings, the assembly 2 further includes an outer protective housing 6 which is preferably ultrasonically welded to the inner housing 4 to cover the inner housing 4 of the assembly 2.

In the embodiment of the switchable modular jack assembly 2 of the present invention shown in FIGS. 1-6, and as illustrated in particular in FIGS. 5 and 6, two electrical circuits may be made between the resilient leaf spring contacts 8 of the assembly 2 and the contacts of either the RJ14 adapter plug 20 or the contacts of the standard RJ14 plug 12, depending upon whether the standard RJ14 plug 12 is received by the plug receptacle 10 of the assembly 2. As shown in FIG. 6, when no RJ14 plug 12 is inserted into the receptacle 10 of the assembly 2, the resilient free ends 36 of the leaf spring contacts 8 extend further into the receptacle 10 and socket 18 to engage the exposed contacts on the RJ14 adapter plug 20. This makes an electrical connection between wires 34 connected to the resilient leaf spring contacts 8 and wires 22 connected to the contacts of the RJ14 adapter plug 20.

However, and as illustrated by FIG. 5 of the drawings, when a standard RJ14 plug 12 is inserted into the plug receptacle 10 on the switchable modular jack assembly 2, the body of the plug 12 pushes the ends 36 of the leaf spring contacts 8 away from the RJ14 adapter plug contacts, breaking the electrical circuit between them. When the plug 12 is fully inserted into the receptacle 10, the contacts of the RJ14 modular plug 12 touch the leaf spring contacts 8 and complete an electrical circuit between the wires 34 connected to the leaf spring contacts 8 and the wires 14 connected to the RJ14 plug 12.

The switchable modular jack assembly 2 of the present invention may be used in different configurations and for different purposes, including testing by the customer to determine if a fault resides in the telephone company wiring or in the wiring in the customer side premises. For example, the assembly 2 may provide a normal electrical connection between the central office, or telco, wiring to the customer side wiring when no RJ14 plug 12 is inserted into the plug receptacle 10 of the assembly 2. In this configuration, the leaf spring contacts 8 of the assembly 2 are wired to the telco lines, and the contacts of the RJ14 adapter plug 20 are connected to the customer side wiring. Without the standard RJ14 plug 12 in place in the receptacle 10, the leaf spring contacts 8 engage the contacts of the RJ14 adapter plug 20 to connect the wiring from the telephone company to the wiring on the customer side premises through the assembly 2.

However, and to test the wiring to determine where a fault exists, the customer may simply insert a standard RJ14 plug connected to another piece of equipment, such as a telephone, into the plug receptacle 10 of the assembly 2. By the customer doing this, the electrical circuit between the leaf spring contacts 8, connected to the telco wiring, and the RJ14 adapter plug contacts, connected to the customer side wiring, will be broken, and an electrical circuit will be made between the leaf spring contacts 8, connected to the telco wiring, and the customer's telephone connected by a wire cable to the standard RJ14 plug 12 which is inserted into the plug receptacle 10 of the assembly 2. The customer can then determine if a fault in the wiring exists on the telephone company side of the NID or in the wiring of his premises.

In yet another configuration, the switchable modular jack assembly 2 of the present invention may be used with the standard RJ14 plug 12 in place in the plug receptacle 10 of the assembly 2 during normal operation. The RJ14 plug 12 may be connected to the customer side wiring, and thus, when the plug 12 is inserted into the plug receptacle 10 of the assembly 2, an electrical circuit is made between the leaf spring contacts 8 of the assembly 2, connected to the telephone company wiring, and the customer side wiring. The RJ14 adapter plug 20 may have its contacts connected to one or more SELT circuits for automated testing by the telephone company.

If a problem occurs in telephone or data reception in the customer premises, the customer would be instructed to remove the standard RJ14 plug 12 from the plug receptacle 10 of the assembly 2. By the customer doing this, the leaf spring contacts 8 would be biased outwardly to engage the exposed contacts of the RJ14 adapter plug 20, which are connected to the SELT circuits. The telephone company may then run loop tests, to determine if a fault exists in the wiring on the telephone company side of the NID.

As can be seen from the foregoing description, and as shown in the drawings, and in particular, FIGS. 1-6 thereof, the switchable modular jack assembly 2 of the present invention, in accordance with the first embodiment thereof, includes a housing 4 having a first side surface 7 in which is formed a receptacle 10 for receiving an RJ14 modular plug 12 having exposed electrical contacts thereon, a first set of at least four electrical contacts 8 mounted to the housing 4, and a second set of at least four electrical contacts 9 (for example, the contacts situated on the adapter plug 20) mounted to the housing 4. Each electrical contact 8 of the first set of at least four electrical contacts is in the form of a leaf spring electrical contact and has a proximate end 32 secured to the housing 4 and a leaf spring distal end 36 situated opposite the proximate end 32. The leaf spring distal end 36 of each leaf spring electrical contact 8 has a first portion 11 which is biased to extend into the receptacle 10 for receiving the RJ14 modular plug 12, and a second portion 13 adjacent the first portion 11 which is biased to selectively contact a respective electrical contact 9 of the second set of at least four electrical contacts (e.g., the contacts of the adapter plug 20).

The second portion 13 of the distal end 36 of each leaf spring electrical contact 8 of the first set of at least four electrical contacts contact a respective electrical contact 9 of the second set of at least four electrical contacts to provide an electrical connection between the leaf spring electrical contacts 8 of the first set of at least four electrical contacts and the electrical contacts 9 of the second set of at least four electrical contacts when the RJ14 modular plug 12 is not received by the receptacle 10 formed in the first side surface 7 of the housing 4. However, when the RJ14 modular plug 12 is received by the receptacle 10 formed in the first side surface 7 of the housing 4, the second portion 13 of the distal end 36 of each leaf spring electrical contact 8 of the first set of at least four electrical contacts is moved away by the RJ14 modular plug 12 from contact with the respective electrical contact 9 of the second set of at least four electrical contacts, and the first portion 11 of the distal end 36 of each leaf spring electrical contact 8 of the first set of at least four electrical contacts contact a respective exposed electrical contact on the RJ14 modular plug 12 to provide an electrical connection between the leaf spring electrical contacts 8 of the first set of at least four electrical contacts and the RJ14 modular plug electrical contacts.

Figure 8:
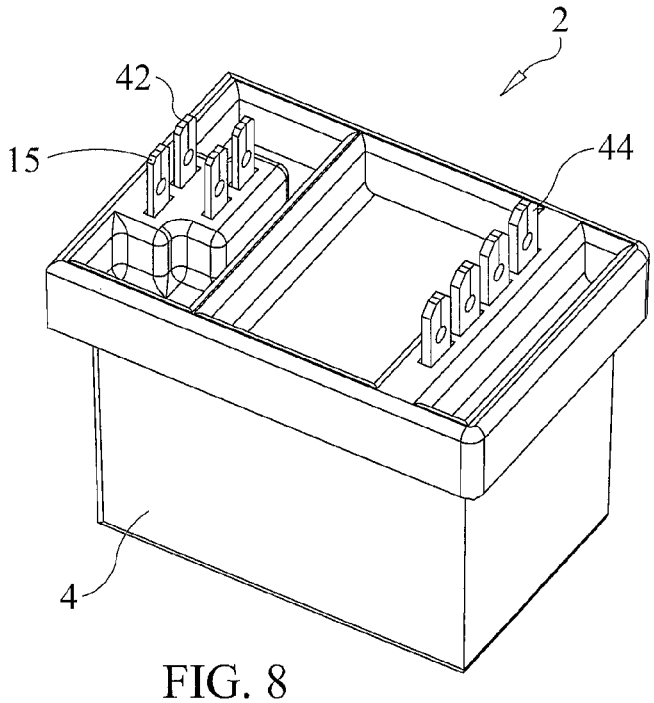
FIG. 8 is a bottom perspective view of the alternative form of the switchable modular jack assembly of the present invention shown in FIG. 7.

In a preferred form of the switchable modular jack assembly 2, a portion of the proximate end 32 of each leaf spring electrical contact 8 of the first set of at least four electrical contacts extends outwardly from the second side surface 17 of the housing 4 in which the socket 18 is formed and includes a free end in the form of an insulation displacement contact (IDC) 15 (see FIG. 8). Furthermore, in another preferred form, the first set of at least four electrical contacts 8 includes a first contact 8*a*, a second contact 8*b*, a third contact 8*c* and a fourth contact 8*d*, and the switchable modular jack assembly 2 further includes a red wire 34*a* electrically connected to the first contact 8*a*, a green wire 34*b* electrically connected to the second contact 8*b*, a yellow wire 34*c* electrically connected to the third contact 8*c*, and a black wire 34*d* electrically connected to the fourth contact 8*d*.

Similarly, in yet another preferred form of the present invention, the second set of at least four electrical contacts 9 includes a first contact 9*a*, a second contact 9*b*, a third contact 9*c* and a fourth contact 9*d*, and the switchable modular jack assembly 2 further includes a red wire 22*a* electrically connected to the first contact 9*a*, a green wire 22*b* electrically connected to the second contact 9*b*, a yellow wire 22*c* electrically connected to the third contact 9*c*, and a black wire 22*d* electrically connected to the fourth contact 9*d*.

The housing 4 of the switchable modular jack assembly 2 referred to previously may constitute an inner housing. If so, then the switchable modular jack assembly 2 may further include an outer protective housing 6, the outer protective housing 6 at least partially covering the inner housing 4.

In yet another form of the present invention, the switchable modular jack assembly 2 includes an inner housing 4, at least four leaf spring electrical contacts 8 at least partially disposed within the inner housing 4, and a pre-wired adapter plug 20 mated to the inner housing 4. The inner housing 4 has a first side surface 7 and a second side surface 17 disposed opposite the first side surface 7. The first side surface 7 of the inner housing 4 has formed therein a receptacle 10, the receptacle 10 being dimensioned for closely receiving an RJ14 modular plug 12 having exposed electrical contacts thereon, and the second side surface 17 of the inner housing 4 has formed therein a socket 18 for captively receiving the pre-wired adapter plug 20, the adapter plug 20 having a first side surface on which is at least partially exposed at least four electrical contacts 9.

In this embodiment of the switchable modular jack assembly 2, each of the at least four leaf spring electrical contacts 8 of the inner housing 4 includes a proximate end 32 secured to the inner housing 4 and a leaf spring distal end 36 situated opposite the proximate end 32. The leaf spring distal end 36 of each leaf spring electrical contact 8 has a first portion 11 which is biased to extend into the receptacle 10 for receiving the RJ14 modular plug 12, and a second portion 13 adjacent the first portion 11 which is biased to extend into the socket 18 which captively receives the pre-wired adapter plug 20.

The second portion 13 of the distal end 36 of each leaf spring electrical contact 8 of the inner housing 4 contacts a respective electrical contact 9 of the at least four electrical contacts of the pre-wired adapter plug 20 to provide an electrical connection between the leaf spring electrical contacts 8 and the adapter plug electrical contacts 9 when the RJ14 modular plug 12 is not received by the receptacle 10 formed in the first side surface 7 of the inner housing 4. However, when the RJ14 modular plug 12 is received by the receptacle 10 formed in the first side surface 7 of the inner housing 4, the second portion 13 of the distal end 36 of each leaf spring electrical contact 8 of the inner housing 4 is moved away by the RJ14 modular plug 12 from contact with the respective electrical contact 9 of the at least four electrical contacts of the pre-wired adapter plug 20, and the first portion 11 of the distal end 36 of each leaf spring electrical contact 8 contacts a respective exposed electrical contact on the RJ14 modular plug 12 to provide an electrical connection between the leaf spring electrical contacts 8 and the RJ14 modular plug electrical contacts.

Preferably, the pre-wired adapter plug 20 includes opposite lateral side surfaces 19, and a barb 24 formed on and extending outwardly from each opposite lateral side surface 19. Furthermore, the inner housing 4 includes lateral side surfaces 21 which define opposite sides of the socket 18 for receiving the pre-wired adapter plug 20. Each lateral side surface 21 of the inner housing 4 has a recess 26 formed therein, each recess 26 at least partially receiving a respective barb 24 of the pre-wired adapter plug 20, whereby the pre-wired adapter plug 20 is captively received by the socket 18 of the inner housing 4. Each recess 26 could be in the form of an opening formed through the thickness of each of the lateral side surfaces 21 of the inner housing 4. Additionally, each leaf spring electrical contact 8 of the inner housing 4 may be situated in a respective channel 23 formed in the inner housing 4 to provide guidance for and to maintain a spaced apart separation of the leaf spring electrical contacts 8.

As mentioned previously, the switchable modular jack assembly 2 may further include an outer protective housing 6, the outer protective housing 6 at least partially covering the inner housing 4. Also, the inner housing 4 may define an opening 25 interconnecting the receptacle and the socket, the distal ends of the leaf spring electrical contacts passing through the interconnecting opening 25 between the receptacle 10 and the socket 8.

An alternative version of the switchable modular jack assembly 2 of the present invention is shown in FIGS. 7-11 of the drawings. The inner housing 4 and contacts of the assembly 2 are shown, and the outer protective housing of the assembly 2 has been omitted to facilitate an understanding of the invention.

Figure 7:
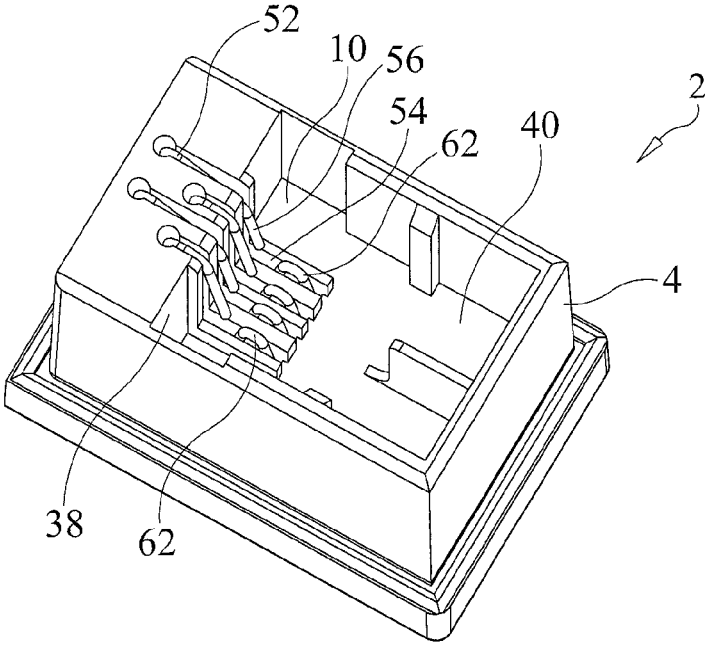
FIG. 7 is a top perspective view of an alternative form of a switchable modular jack assembly constructed in accordance with the present invention.
Figure 9:
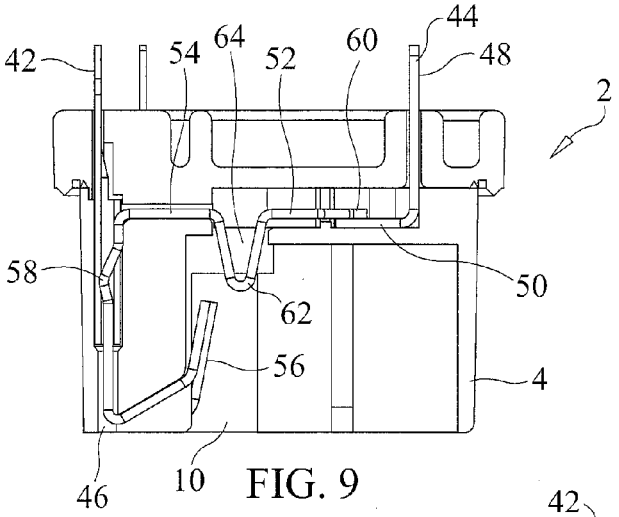
FIG. 9 is a longitudinal cross-sectional view of the alternative form of the switchable modular jack assembly of the present invention shown in FIGS. 7 and 8.
Figure 10:
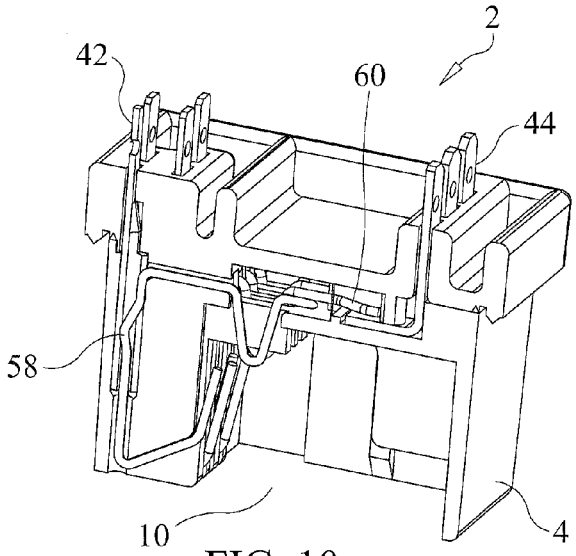
FIG. 10 is a longitudinal, partially cut away, perspective view of the alternative form of the switchable modular jack assembly of the present invention shown in FIGS. 7 and 8.
Figure 11:
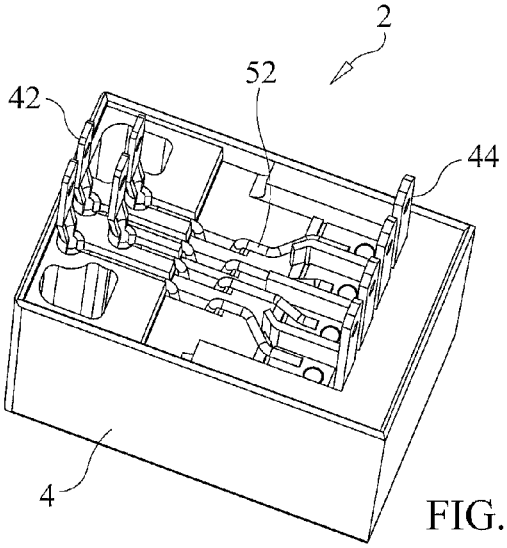
FIG. 11 is a transverse, partially cut away, perspective view of the alternative form of the switchable modular jack assembly of the present invention shown in FIGS. 7 and 8.

As shown in FIGS. 7, 9 and 10 of the drawings, one side of the inner housing 4 is formed with a receptacle 10 for receiving a standard RJ14 plug 12. Four wire leaf spring contacts 52 extend into the plug receptacle 10 in two places—on one lateral side 38 of the plug receptacle 10 and on the bottom side 40 of the plug receptacle 10.

As can be seen from FIGS. 8-11 of the drawings, there are two sets 42,44 of four electrical contacts, which are preferably insulation displacement contacts (IDCs) embedded in and retained by the inner housing 4 of the assembly 2 in this embodiment. The contacts of one set 42 are flattened and unbent, and extend downwardly in channels 46 from a side of the inner housing 4 of the assembly 2 that is opposite the side in which the plug receptacle 10 is formed. The contacts of the second set 44 are also flattened but bent into an L-shape so that they have IDC end portions 48 extending outwardly from the same side of the inner housing 4 as the contacts of the other set 42, and bent portions or segments 50 which extend into the housing 4 perpendicularly from the lead ends 48 having the IDC terminals.

Four wire leaf spring contacts 52 reside within individual guide slots 54 formed in the interior of the inner housing 4. A first resilient axial end 56 of each leaf spring contact 52 extends from its respective slot 54 into the plug receptacle 10 from a lateral side 38 thereof. These resilient first ends 56 are positioned in alignment to make contact with the contacts of a standard RJ14 plug 12 when the plug is inserted into the plug receptacle 10 of the assembly 2 in this embodiment. The leaf spring contacts 52 extend from their first ends 56 into respective channels 46 where the contacts of the first set 42 of electrical contacts reside, and exhibit a slight bend or bump 58 where they closely engage, by pressure, the flat side of corresponding contacts of the first set 42 of electrical contacts. The leaf spring contacts 52 continue in their extension from this point of engagement with the contacts of the first set 42 in a perpendicular direction to the opposite, second axial end 60 thereof, where the second ends 60 overlie and electrically engage the bent segments 50 of corresponding L-shaped contacts of the second set 44 of electrical contacts.

Each leaf spring contact 52 includes a protruding U-shaped portion 62 situated between the opposite axial ends 56,60 of the leaf spring contacts 52. This U-shaped portion 62 of each leaf spring contact 52 extends through an interior opening 64 in the inner housing 4 and into the plug receptacle 10 at the bottom side 40 thereof.

When no standard RJ14 plug 12 is inserted into the plug receptacle 10 in this embodiment of the assembly 2, the leaf spring contacts 52 serve to connect the contacts of the first set 42 of electrical contacts with respective contacts of the second set 44 of electrical contacts, as the second axial end 60 of each leaf spring contact 52 rests on and engages the bent segment 50 of a corresponding L-shaped contact of the second set 44 of electrical contacts. However, when a standard RJ14 plug 12 is inserted into the plug receptacle 10 of the assembly 2, the body of the plug 12 pushes on the protruding U-shaped portions 62 of the leaf spring contacts 52 extending into the plug receptacle 10 and causes the second axial ends 60 of the leaf spring contacts 52 to lift and disengage from the bent segments 50 of the L-shaped contacts of the second set 44 of electrical contacts, thereby breaking the electrical circuit between the first set 42 of contacts and the second set 44 of contacts. Also, then, the first axial end 56 of each resilient contact 52 of the assembly 2, extending into the plug receptacle 10 from a lateral side 38 thereof, electrically engages a corresponding contact of the standard RJ14 plug 12 inserted into the plug receptacle 10. Thus, when the standard RJ14 plug 12 is inserted into the plug receptacle 10 of the assembly 2, an electrical circuit is completed between the contacts of the standard RJ14 plug 12 and the contacts of the first set 42 of electrical contacts, through the leaf spring contacts 52 situated within the inner housing 4 of the assembly 2.

As can be seen from the foregoing description, the switchable modular jack assembly 2 of the present invention includes few components and is simple in structure and cost effective to manufacture. Also, the assembly is easy to use by a customer to test the wiring in his premises.

The switchable modular jack assembly 2 of the present invention accepts and interfaces with a standard RJ14 plug 12, and may be used to test not only the standard tip (green) and ring (red) lines, but also the yellow and black lines commonly used in transmitting data and telephony signals.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A switchable modular jack assembly for telecommunications systems, which comprises:

an inner housing;

at least four leaf spring electrical contacts at least partially disposed within the inner housing; and a pre-wired adapter plug mated to the inner housing;

wherein the inner housing has a first side surface and a second side surface disposed opposite the first side surface;

wherein the first side surface of the inner housing has formed therein a receptacle, the receptacle being dimensioned for closely receiving an RJ14 modular plug having exposed electrical contacts thereon;

wherein the second side surface of the inner housing has formed therein a socket for captively receiving the pre-wired adapter plug, the adapter plug having a first side surface on which is at least partially exposed at least four electrical contacts;

wherein each of the at least four leaf spring electrical contacts of the inner housing includes a proximate end secured to the inner housing and a leaf spring distal end situated opposite the proximate end, the leaf spring distal end of each leaf spring electrical contact having a first portion which is biased to extend into the receptacle for receiving the RJ14 modular plug, and a second portion adjacent the first portion which is biased to extend into the socket which captively receives the pre-wired adapter plug;

wherein the second portion of the distal end of each leaf spring electrical contact of the inner housing contacting a respective electrical contact of the at least four electrical contacts of the pre-wired adapter plug to provide an electrical connection between the leaf spring electrical contacts and the adapter plug electrical contacts when the RJ14 modular plug is not received by the receptacle formed in the first side surface of the inner housing; and wherein, when the RJ14 modular plug is received by the receptacle formed in the first side surface of the inner housing, the second portion of the distal end of each leaf spring electrical contact of the inner housing is moved away by the RJ14 modular plug from contact with the respective electrical contact of the at least four electrical contacts of the pre-wired adapter plug, and the first portion of the distal end of each leaf spring electrical contact contacting a respective exposed electrical contact on the RJ14 modular plug to provide an electrical connection between the leaf spring electrical contacts and the RJ14 modular plug electrical contacts.

2. The switchable modular jack assembly as defined by claim 1, wherein the pre-wired adapter plug includes opposite lateral side surfaces, and a barb formed on and extending outwardly from each opposite lateral side surface; and wherein the inner housing includes lateral side surfaces which define opposite sides of the socket for receiving the pre-wired adapter plug, each lateral side surface of the inner housing having a recess formed therein, each recess at least partially receiving a respective barb of the pre-wired adapter plug whereby the pre-wired adapter plug is captively received by the socket of the inner housing.

3. The switchable modular jack assembly as defined by claim 2, wherein each recess is an opening formed through the thickness of each of the lateral side surfaces of the inner housing.

4. The switchable modular jack assembly as defined by claim 1, wherein each leaf spring electrical contact of the inner housing is situated in a respective channel formed in the inner housing to provide guidance for and to maintain a spaced apart separation of the leaf spring electrical contacts.

5. The switchable modular jack assembly as defined by claim 1, wherein a portion of the proximate end of each leaf spring electrical contact of the inner housing extends outwardly from the second side surface thereof in which the socket is formed and includes a free end in the form of an insulation displacement contact (IDC).

6. The switchable modular jack assembly as defined by claim 1, wherein the at least four leaf spring electrical contacts include a first contact, a second contact, a third contact and a fourth contact; and wherein the switchable modular jack assembly further comprises a red wire electrically connected to the first contact, a green wire electrically connected to the second contact, a yellow wire electrically connected to the third contact, and a black wire electrically connected to the fourth contact.

7. The switchable modular jack assembly as defined by claim 1, wherein the at least four electrical contacts of the pre-wired adapter plug include a first contact, a second contact, a third contact and a fourth contact; and wherein the pre-wired adapter plug further includes a red wire electrically connected to the first contact, a green wire electrically connected to the second contact, a yellow wire electrically connected to the third contact and a black wire electrically connected to the fourth contact.

8. The switchable modular jack assembly as defined by claim 1, which further comprises:

an outer protective housing, the outer protective housing at least partially covering the inner housing.

9. The switchable modular jack assembly as defined by claim 1, wherein the inner housing defines an opening interconnecting the receptacle and the socket, the distal ends of the leaf spring electrical contacts passing through the interconnecting opening between the receptacle and the socket.

* * * * *